US007554309B2

(12) United States Patent
Carpenter, Jr. et al.

(10) Patent No.: US 7,554,309 B2
(45) Date of Patent: Jun. 30, 2009

(54) CIRCUITS, DEVICES AND METHODS FOR REGULATOR MINIMUM LOAD CONTROL

(75) Inventors: John H. Carpenter, Jr., Rowlett, TX (US); Brett J. Thompsen, Dallas, TX (US); Benjamin L. Amey, Allen, TX (US); Zhihong You, Plano, TX (US); Joseph A. Devore, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 187 days.

(21) Appl. No.: 11/132,750

(22) Filed: May 18, 2005

(65) Prior Publication Data

US 2006/0261793 A1 Nov. 23, 2006

(51) Int. Cl.
*G05F 1/40* (2006.01)

(52) U.S. Cl. ..... 323/282

(58) Field of Classification Search ..... 323/222, 323/224, 280, 282, 283, 284, 351
See application file for complete search history.

(56) References Cited

U.S. PATENT DOCUMENTS

| | | | | |
|---|---|---|---|---|
| 5,481,178 | A * | 1/1996 | Wilcox et al. | 323/287 |
| 5,864,227 | A * | 1/1999 | Borden et al. | 323/280 |
| 6,201,375 | B1 * | 3/2001 | Larson et al. | 323/277 |
| 6,580,258 | B2 * | 6/2003 | Wilcox et al. | 323/282 |
| RE38,940 | E * | 1/2006 | Isham et al. | 323/224 |

* cited by examiner

*Primary Examiner*—Adolf Berhane
(74) *Attorney, Agent, or Firm*—William B. Kempler; W. James Brady; Frederick J. Telecky, Jr.

(57) ABSTRACT

Systems, methods and circuits for regulator minimum load control. In one particular case, a system is provided that includes a load control circuit and a switched load. The load control circuit includes a reference current, and a sense current representative of a load current. In addition, the load control circuit includes a comparator circuit that drives a control signal in response to a comparison between the reference current and the sense current. The switched load is electrically coupled to a load voltage signal to provide loading to the load voltage signal. The switched load is operable to switch between a first loading factor and a second loading factor in response to the control signal.

8 Claims, 3 Drawing Sheets

CIRCUITS, DEVICES AND METHODS FOR REGULATOR MINIMUM LOAD CONTROL

BACKGROUND OF THE INVENTION

The present invention is related to voltage regulators. More particularly, the present invention is related to circuits, systems and methods for maintaining voltage regulators at a desired loading condition.

A prior art regulated system 100 is depicted in FIG. 1. Regulated system 100 includes a voltage regulator 110 that regulates an input voltage 102, and outputs a regulated voltage 120 to an overall load 140. Voltage regulator 110 includes an operational amplifier 112 receiving input voltage 102 and driving a FET 114. The drain of FET 114 is tied to a voltage source 122, and the source of FET 114 drives regulated voltage 120. A feedback loop of operational amplifier 112 is driven by the regulated voltage signal as divided by resistors 116, 118.

Overall load 140 includes a drive load 132 and a dummy load 136. Dummy load 136 is a resistive load, and is included to assure that voltage regulator 110 is always supplying at least some load. By maintaining at least some loading on voltage regulator 110, operational amplifier 112 is maintained in a desired range of operation and regulated voltage 120 is maintained relatively constant. However, maintaining minimum loading through use of dummy load 136 is wasteful. In particular, dummy load 136 is always drawing current from voltage regulator 110 which is dissipated as heat. Both the heat and the wasted current are undesirable.

Hence, for at least the aforementioned reasons, there exists a need in the art for advanced circuits, systems and methods for regulating voltages.

BRIEF SUMMARY OF THE INVENTION

The present invention is related to voltage regulators. More particularly, the present invention is related to circuits, systems and methods for maintaining voltage regulators at a desired loading condition.

Various embodiments of the present invention provide circuits for regulator minimum load control. The circuits include a load control circuit and a switched load. The load control circuit includes a reference current, and a sense current representative of a load current. In addition, the load control circuit includes a comparator circuit that drives a control signal in response to a comparison between the reference current and the sense current. The switched load is electrically coupled to a load voltage signal and to the control signal from the load control circuit. The switched load is operable to switch between a first loading factor and a second loading factor in response to the control signal.

As just one of many examples, such a circuit may be used to selectively load a voltage regulator by asserting/de-asserting the control signal. In such a case, the circuit may further include a voltage regulator circuit that provides the load current and the load voltage signal to the switched load. The load current may include a drive load component and switched load component. The drive load component includes current provided to a drive load attached to the voltage regulator, and the switched load component includes current provided to the switched load.

In some instances of the embodiments, the switched load includes a transistor and a resistor. In such instances, the transistor is used to selectively control current flow to the resistor. Thus, the transistor may be used to modify the switched load between a resistive load approximately equal to the resistor and a no-load (i.e., open) condition. In one particular instance, the transistor is controlled by a substantially binary control signal that transitions between a logical '1' state and a logical '0' state. As an example, in the logical '1' state the switched load has a load approximately equal to the resistor, and in the logical '0' state the switched load looks like an open or no-load. In some cases, the resistor is selected to provide a minimum load. This "minimum load" is defined as a load drawing a current sufficient to maintain the regulator circuit in an operationally stable, or otherwise desirable state.

In various instance of the embodiments, the comparator circuit comprises a bipolar transistor. In such instances, the sense current may be electrically coupled to the base of the bipolar transistor, and the reference current may be electrically coupled to the collector of the bipolar transistor. The control signal provided by the comparator may also be electrically coupled to the collector of the bipolar transistor.

Other embodiments of the present invention provide methods for controlling voltage regulator loading. Such methods include providing a voltage regulator circuit, a reference current and a switched load. The voltage regulator circuit provides a load current and a load voltage signal, and the switched load is electrically coupled to the load voltage signal. The methods further include comparing a representation of the load current with the reference current. Based at least in part on comparing the representation of the load current with the reference current, a load control signal is activated (i.e., asserted). Upon activating the load control signal, the switched load is transitioned from a first loading factor to a second loading factor.

Yet other embodiments of the present invention provide systems for regulator minimum load control. The systems include a voltage regulator circuit that drives a load voltage signal and provides a load current. In addition, the systems include a switched load and a load control circuit. The switched load is electrically coupled to the load voltage signal. The load control circuit is operable to sense the load current, and based thereon, to modify and/or activate the switched load. In some instances of the embodiments, the switched load is a smooth switched load capable of switching between three or more load factors, while in other instances the switched load is a step switched load capable of switching between two load factors. In particular instances of the embodiments, modification of the switched load is performed via a load control signal. In such cases, the load control signal may be a substantially binary signal transitioning between an active state and an inactive state, or a substantially smooth signal transitioning between three or more distinct levels or states.

This summary provides only a general outline of some embodiments of the present invention. Many other objects, features, advantages and other embodiments of the present invention will become more fully apparent from the following detailed description, the appended claims and the accompanying drawings.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
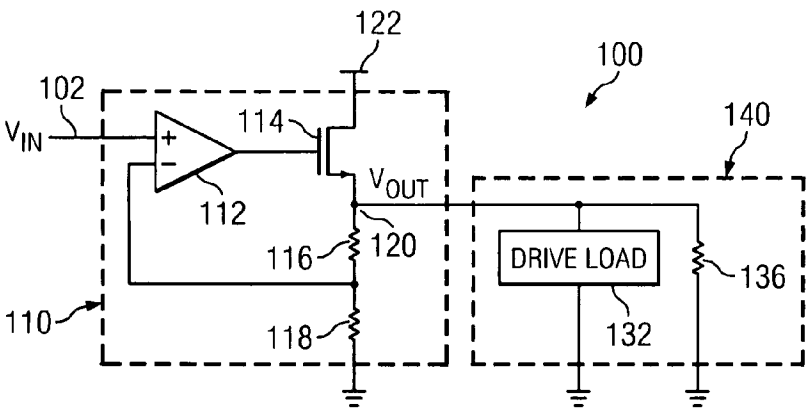
FIG. 1 (PRIOR ART)
FIG. 1 depicts a prior art voltage regulator and switch load.

The present invention is related to voltage regulators. More particularly, the present invention is related to circuits, systems and methods for maintaining voltage regulators at a desired loading condition.

Various embodiments of the present invention provide circuits, systems and methods for regulator load control. Such embodiments may include a load control circuit and a switched load. The load control circuit may include a reference current and a sense current representative of a load current. In addition, the load control circuit may include a comparator circuit that drives a load control signal in response to a comparison between the reference current and the sense current. The load control signal is operable to switch the switched load between various supported load factors. As used herein, the term "load factor" is used in its broadest sense to mean any circuit load. In some cases, the load is a purely resistive load. In other cases, the load is a purely capacitive or inductive load, while in other cases, the load is some combination of resistive, capacitive, and/or inductive loads.

As just one of many examples, such embodiments may be used to selectively load a voltage regulator by asserting/de-asserting the load control signal. In such a case, the circuit may further include a voltage regulator circuit that provides the load current and the load voltage signal to the switched load. The load current may include a drive load component and switched load component. The drive load component includes current provided to a drive load attached to the voltage regulator, and the switched load component includes current provided to the switched load. As used herein, the term "drive load" includes any load other than the switched load that is being driven by the voltage regulator.

In some cases, the sense current may be a representation of the load current. For the purposes of this document, the term "representation" is used in its broadest sense to mean any value mathematically related to any other value. Thus, as just some general examples, the sense current may be some percentage of the load current, the load current plus some offset current, and/or a combination of the aforementioned. Based on the disclosure provided herein, one of ordinary skill in the art will appreciate the myriad of relationships between a sense current and a load current that are considered a "representation of the load current".

As used herein, the term "switched load" is used in its broadest sense to mean any load capable of being switched between two or more loading factors. There are generally two types of switched loads: a "step" switched load capable of switching between two loading factors, and a "smooth" switched load capable of switching between three or more loading factors. Thus, as will be appreciated by one of ordinary skill in the art, a smooth switched load may be switched between three discreet points across a continuum, between an upper limit (potentially a thousand or more) of points across the continuum, or between any number of points between three and the upper limit.

The load control signal may be a step signal capable of toggling between two detectable levels. In general, the two levels are a logical '1' and a logical '0' level. In one case, the logical '1' level is associated with a supply voltage level and the logical '0' level is associated with a ground level, however, one of ordinary skill in the art will appreciate a number of associations that can correspond with the logical '0' and logical '1' levels. Alternatively, the load control signal may be a "smooth" signal capable of transitioning between three or more detectable levels. Thus, as will be appreciated by one of ordinary skill in the art, a smooth load control signal may be switched between three discreet points across a continuum, between an upper limit (potentially a thousand or more) of points across the continuum, or between any number of points between three and the upper limit.

Also, as used herein, the term "electrically coupled" is used in its broadest sense to mean any type of coupling whereby an electrical connection is made between two endpoints. Thus, for example, two devices electrically connected via a wire or other conductive path are electrically coupled. Alternatively, two end devices separated by one or more electrically conductive devices are electrically coupled where there is a signal path capable of passing some electrical current originating at one end device to the other end device. It should be noted that not all current originating at one end device must be received at the other end device for the devices to be considered electrically coupled. Rather, only some portion of the current need pass from one end device to the other end device to be electrically coupled in accordance with the definition use herein.

Figure 2B:
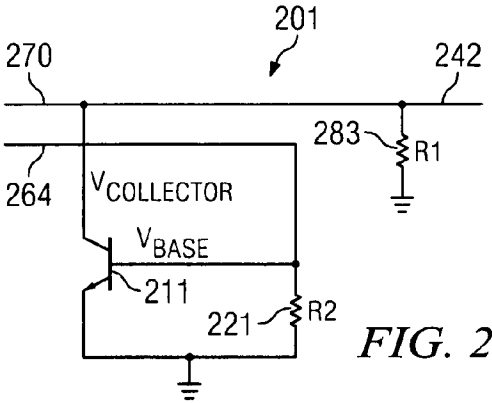
FIG. 2B illustrates an exemplary comparator circuit useful in relation to one or more embodiments of the present invention.
Figure 2A:
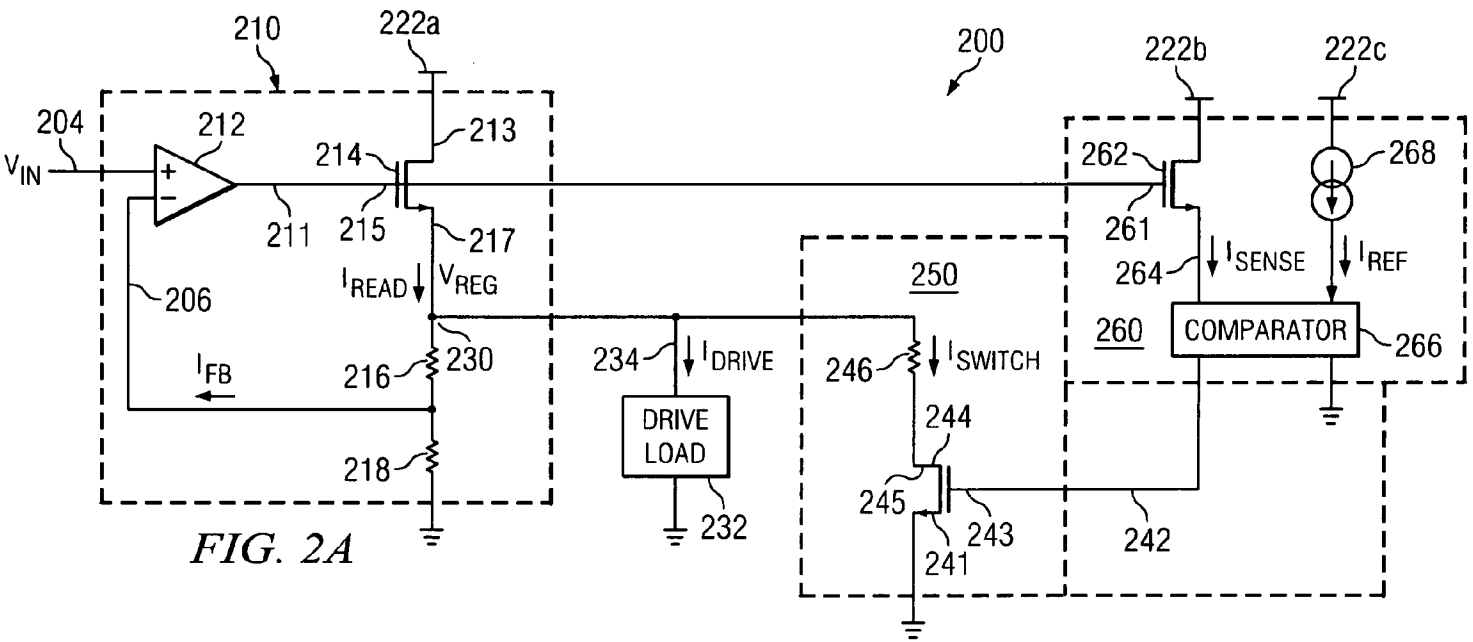
FIG. 2A depicts a voltage regulator associated with a load control circuit and switched load in accordance with various embodiments of the present invention.

Turning to FIG. 2A, a switched load system 200 in accordance with various embodiments of the present invention is illustrated. Switch load system 200 includes a switched load 250 and a load control circuit 260 coupled to a voltage regulator 210. In operation, voltage regulator 210 supplies power to a drive load 232. For the purposes of this document, drive load 232 may be any electrical load receiving current from voltage regulator 210. Thus, for example, drive load 232 may be as simple as a resistor, or something more complex such as a microprocessor circuit. In operation, drive load 232 draws a drive current ($I_{drive}$), and voltage regulator 210 supplies a load current ($I_{load}$).

Voltage regulator circuit 210 includes an operational amplifier 212 receiving an input voltage ($V_{in}$) 204 and driving a gate 215 of a Field Effect Transistor ("FET") 214. A drain 213 of FET 214 is connected to a voltage source 222, and a source 217 of FET 214 is connected to a node 230 exhibiting a regulated voltage ($V_{reg}$). A feedback loop 206 of operational amplifier 212 is connected to a node 229 exhibiting a $V_{reg}$ as divided by resistors 216, 218. A relatively small feedback current ($I_{fb}$) flows through feedback loop 206.

Operational amplifier outputs a control voltage 211 depending on a difference between input voltage 204 and the voltage exhibited on feedback loop 206. FET 214 allows $I_{load}$ to pass from drain 213 to source 217 depending upon control voltage 211. When voltage regulator 210 is maintained in a defined operational range, operational amplifier 212 acts to force the voltage exhibited on feedback loop 206 to be the same as input voltage 204. This process results in the desired condition of a stable $V_{reg}$ at node 230 across a reasonably wide range of loads. However, when voltage regulator 210 is unloaded (i.e., no load is coupled to node 230), operational amplifier 212 can become unstable. The instability of operational amplifier 212 results in undesired instability of $V_{reg}$.

The combination of switched load 250 and load control circuit 260 operate to reduce or eliminate the possibility that operational amplifier 212 will become unstable by assuring that voltage regulator 210 is always driving at least a minimum load. To do this, load control circuit 260 monitors the operation of voltage regulator 210 to determine when drive load 232 is either removed, or does not present a load factor to voltage regulator 210 that is sufficient to maintain voltage regulator 212 in an operational range. Where this situation is detected, load control circuit 260 activates switched load 250 such that voltage regulator 210 is maintained in a minimum loading situation.

Load control circuit 260 includes a current source 268 that provides a reference current ($I_{ref}$) to a comparator 266. In addition, load control circuit 260 includes a FET 262 with a gate 261, a drain 213, and a source 264. Drain 213 of FET 262 is connected to voltage source 222, and source 264 of FET 262 drives a sense current ($I_{sense}$). As gate 261 of FET 262 is connected to gate 215 of FET 214, $I_{sense}$ provided from FET 262 is representative of the load current provided by FET 214. Based on the disclosure provided herein, one of ordinary skill in the art will appreciate a variety of components and/or designs that may be adopted to create a sense current that tracks or otherwise represents a load current. As just some examples, the circuit may be designed such that $I_{sense}$ is approximately equal to $I_{load}$, or another circuit may be designed such that $I_{sense}$ is proportional to, but much less than $I_{load}$. $I_{sense}$ is provided to comparator 266 that compares $I_{sense}$ with $I_{ref}$. In response to the comparison, comparator 266 asserts/de-asserts a control signal 242. The following equations describe the operation of comparator 266:

Control Signal=Asserted, where $I_{sense<=Iref}$; and

Control Signal=De-asserted, wherein $I_{sense>Iref}$.

Based on the forgoing equations, it will be recognized that control signal 242 is a substantially binary signal transitioning between a logical '1' and a logical '0' state. As used herein, the term "substantially binary" refers to a signal that is intended for detection at two different states: asserted and de-asserted. Such a substantially binary signal may be a square wave, or a sinusoidal wave passing through distinct thresholds defining the active and inactive states. Such a signal is useful in switching a step switched load.

Switched load 250 includes a resistor 246 connected between drain 245 of a FET 244 and node 230. Control signal 242 is connected to a gate 241 of FET 244. Thus, when control signal 242 is asserted, resistor 246 is added as a load to node 230. In this condition a switch current ($I_{switch}$) passes through resistor 246 and FET 244. Conversely, when control signal 242 is de-asserted FET 244 does not allow current to flow through resistor 246, and resistor 246 is effectively removed as a load from node 230. The following equations describe the operation of switched load 250:

Switched Load=Resistor, where Control Signal is asserted; and

Switched Load=Open, where Control Signal is de-asserted.

Based on the forgoing equations, it will be recognized that switched load 250 is a step switched load. In this particular case, the load values or factors of switched load 250 are finite and open.

Turning now to FIG. 2B, an exemplary comparator circuit 201 that may be used to perform the functions of comparator 266 is illustrated. Comparator circuit 201 includes a bipolar transistor 211 with its base connected to source 264 of FET 262 ($I_{sense}$), and its collector connected to current source 268 ($I_{ref}$). Thus, a voltage ($V_{colletor}$) defined by $I_{ref}$ and a resistor (R1) 283 is applied to the collector of bipolar transistor 211, and another voltage ($V_{base}$) defined by $I_{sense}$ and a resistor (R2) 221 is applied to the base of bipolar transistor 211. The following equations describe the voltages where $I_{sense}$ varies in proportion to $I_{load}$:

$$V_{collector}=I_{ref}*R2; \text{ and}$$

$$V_{base}=I_{sense}*R1, \text{ which is proportional to } I_{load}*R1.$$

As $I_{ref}$ is substantially constant, $V_{collector}$ is also substantially constant. In contrast, $V_{base}$ varies in proportion to the changes in $I_{load}$ as represented by $I_{sense}$. Thus, where $I_{load}$ becomes very low due to a disconnect or other change in drive load 232, $V_{base}$ decreases to a point that bipolar transistor turns off, and control signal 242 is asserted, which in this case is at the level of $V_{collector}$. Alternatively, where $I_{load}$ increases as governed by drive load 232, $V_{base}$ increases and bipolar transistor 211 turns on, and control signal 242 is de-asserted, which in this case is approximately ground. Based on the disclosure provided herein, one of ordinary skill in the art will recognize a variety of other comparator circuits that maybe used to perform the functions of comparator 266.

Figure 2C:
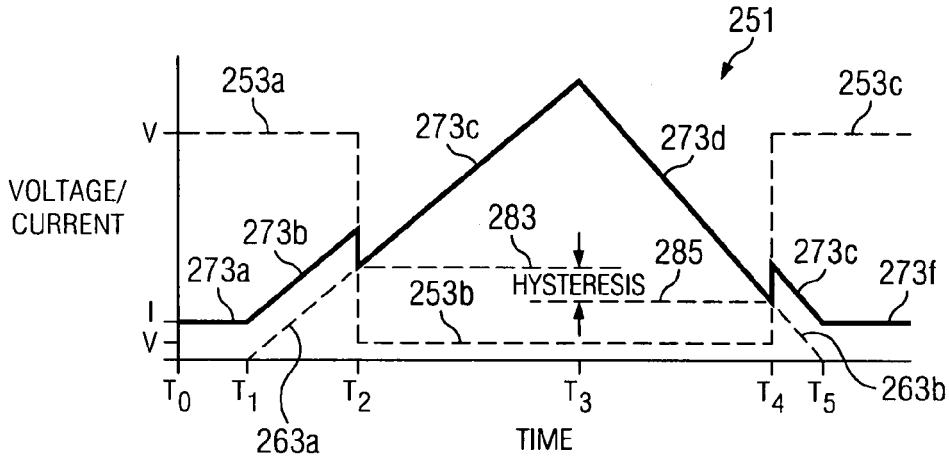
FIG. 2C is a timing diagram illustrating operation of the system depicted in FIGS. 2A-2B.

Turning to FIG. 2C, a graph 251 illustrates the operation of switched load system 200. Graph 251 illustrates current/voltage (vertical axis) verses time (horizontal axis). $I_{load}$ is shown as solid line 273, $I_{drive}$ is shown as dashed line 263 which is coextensive with line 273*c*, 273*b*. Control signal 242 is represented by a dashed line 253, and reference markers 283, 285 indicate the occurrence of hysteresis.

Following graph 251, at time $T_0$ drive load 232 is disconnected from node 230. In this condition, control signal 242 is asserted (shown as dashed line 253*a*) causing FET 244 to turn on and load node 230 with resistor 246. As suggested above, FET 244 is turned on to apply a minimum load factor to node 230 and assure that voltage regulator 210 is maintained in an operationally stable region. With FET 244 turned on and drive load 232 disconnected from node 230, $I_{load}$ is equal to $I_{switch}$ where $I_{fb}$ is assumed to be insignificant. This continues until time $T_1$ when drive load 232 is coupled to node 230 with a load that is linearly decreasing from time $T_1$ to time $T_3$. As shown by line 263*a*, $I_{drive}$ increases as the load presented by drive load 232 decreases. This increasing $I_{drive}$ is added to $I_{switch}$ resulting in $I_{load}$ depicted as line 273*b*. At time $T_2$, $I_{load}$ has increased to the extent that comparator 266 de-asserts control signal 242. With control signal 242 de-asserted (shown as dashed line 253*b*), FET 244 turns off effectively detaching the load of resistor 246 from node 230. At this point, $I_{load}$ is equal to $I_{drive}$ where $I_{fb}$ is assumed to be insignificant (shown as line 273*c*).

Beginning at time $T_3$, the load presented to node 230 by drive load 232 is continually increased until time $T_5$ where drive load 232 is effectively disconnected from node 230. From time $T_3$ until time $T_4$, the load presented to node 230 increases resulting in a corresponding decrease in $I_{load}$ (shown as line 273*d*), but is sufficient to maintain voltage regulator 210 in a stable operational region. At time $T_4$, the load presented at node 230 by drive load 232 becomes insufficient to maintain voltage regulator 210 in an operationally stable condition. At this point, $I_{load}$ has decreased to the extent that load control circuit 260 asserts control signal 242 (shown as dashed line 253*c*). Assertion of control signal 242 causes FET 244 to turn on, whereby node 230 is loaded with resistor 246. At this point, $I_{load}$ (shown as line 273*e*) is equal to $I_{drive}$ (shown as dashed line 263*b*) plus $I_{switch}$. At time $T_5$, drive load 232 appears essentially disconnected from node 230 and $I_{load}$ is equal to $I_{switch}$ where $I_{fb}$ is assumed to be insignificant (shown as line 273*f*).

Graph 251 is contrived to show the effect of transitioning switched load 250 on switched load system 200. It should be noted that $I_{load}$ may assume a number of different wave forms depending upon the operation of drive load 232 and the transition levels selected for switching switched load 250. Further, it should be noted at this juncture that while switched load system 200 is illustrated with particular components including FETs and operational amplifiers, one of ordinary skill in the art upon reading this disclosure will appreciate a variety of other components may be used to create circuitry capable of performing the functions of switched load system 200. Thus, for example, where n-channel FETs are shown it should be recognized that p-channel FETs or bipolar transistors may be used to create similar functionality. Also, one of ordinary skill in the art will recognize that voltage regulator 210 is exemplary of many different types of voltage regulators known in the art. Based on the disclosure provided herein, one of ordinary skill in the art will appreciate that load control circuit 260 and/or switched load 250 may be applied to other types of voltage regulators in accordance with one or more embodiments of the invention. Yet further, one of ordinary skill in the art will appreciate functional equivalents of load control circuit 260 and switched load 250 that may be used in accordance with various embodiments of the present invention.

Figure 3A:
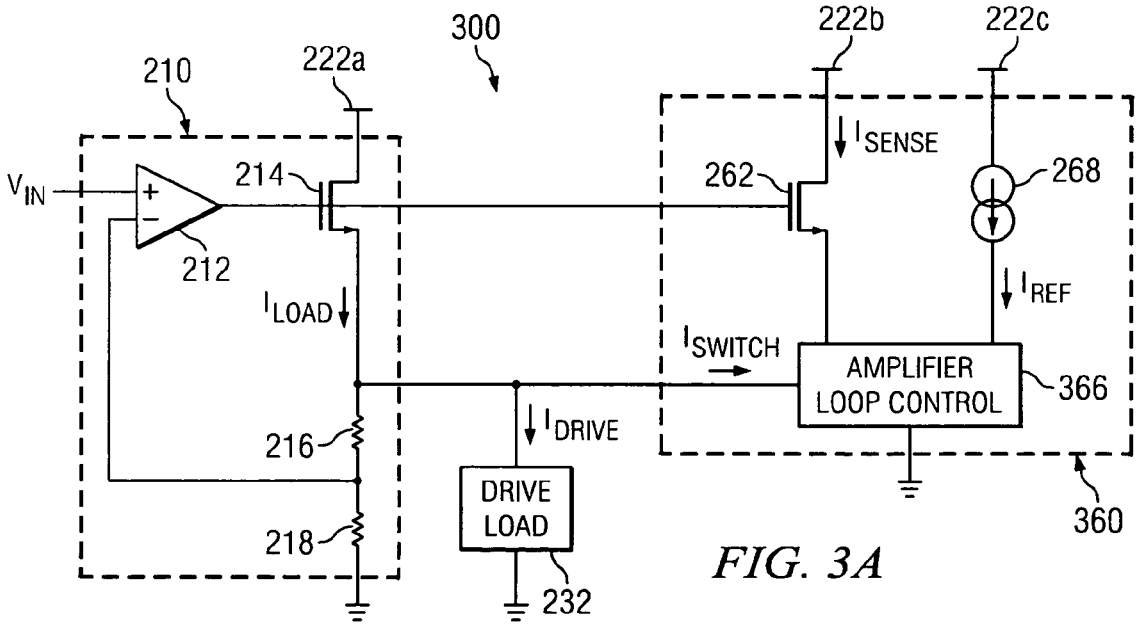
FIG. 3A depicts a voltage regulator associated with a load control circuit and switched load in accordance with other embodiments of the present invention.

Turning now to FIG. 3A, another switched load system 300 in accordance with other embodiments of the present invention is illustrated. Switch load system 300 includes voltage regulator 210 supplying drive load 232 coupled to node 230. In addition, switch load system 300 includes a smoothly varying load control 360 that applies a smooth switched load at node 230. This smooth switched load is applied where drive load 232 becomes insufficient to maintain voltage regulator 210 in an operationally stable condition. Thus, in contrast to switched load system 200 that provided a load current with a step function due to the switching of switched load 250, switched load system 300 provides a smoothly varying load to node 230 in such a way that the step transition on the load current is eliminated.

The smoothly varying load is produced by an amplifier loop circuit 366. Amplifier loop circuit 366 receives $I_{ref}$ and $I_{sense}$. As discussed above, $I_{sense}$ decreases as drive load 232 increases. In this case, where $I_{sense}$ decreases to equal $I_{ref}$, amplifier loop circuit 366 begins applying a load to node 230. This load is varied such that $I_{sense}$ holds at a constant level. Based on the disclosure provided herein, one of ordinary skill in the art will be capable of designing an amplifier loop circuit capable of providing the desired loading condition.

Figure 3B:
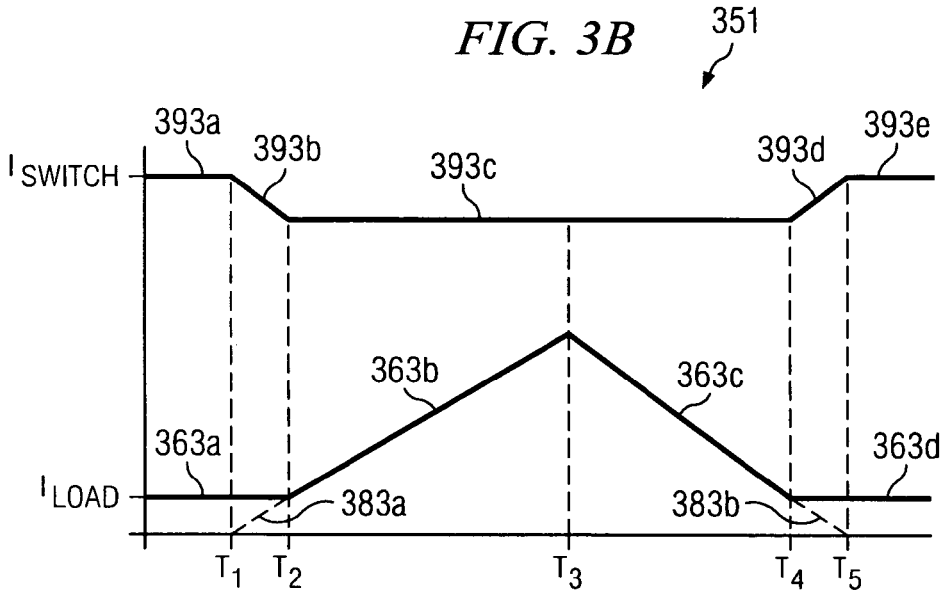
FIG. 3B is a timing diagram illustrating operation of the system depicted in FIG. 3A.

Turning to FIG. 3B, a graph 351 illustrates the operation of switched load system 300. Graph 351 illustrates current/switch load (vertical axis) verses time (horizontal axis). $I_{load}$ is shown as solid line 363, $I_{drive}$ is shown as dashed line 383 which is coextensive with line 363*b*, 363*c*. The switch load applied to node 230 by amplifier loop circuit is shown as line 393.

Following graph 351, at time $T_0$ drive load 232 is disconnected from node 230. In this condition, amplifier loop circuit 366 provides a constant load to node 230. This results in a constant $I_{load}$ (shown as line 363*a*) which continues until time $T_1$. At this time, $I_{drive}$ is zero, and $I_{load}$ is equal to $I_{switch}$ (shown as line 393*a* offset from zero for clarity). At time $T_1$, drive load 232 is coupled to node 230 and presents a linearly decreasing load from time $T_1$ to time $T_3$, and a lineraly increasing load from time $T_3$ to time $T_5$. As shown by line 383*a*, $I_{drive}$ increases as the load presented by drive load 232 decreases. Between time $T_1$ and time $T_2$, $I_{load}$ is approximately equal to $I_{drive}$ plus $I_{switch}$. To maintain $I_{load}$ constant, $I_{switch}$ (shown as line 393*b*) is decreasing at a rate complementary to the increase in $I_{drive}$ (shown as line 383*a*). Thus, between time $T_1$ and $T_2$, the load presented by amplifier loop circuit 366 is increasing. At time $T_2$, the load presented by amplifier loop control 366 appears as an open circuit at node 230, and $I_{switch}$ is zero (shown as line 393*c*). Thus, from time $T_2$ to $T_4$, $I_{load}$ is equal to $I_{drive}$ (shown as lines 363*b* and 363*c*).

From time $T_4$ to time $T_5$, the load presented to node 230 drops below a defined load value, yet $I_{load}$ remains constant (shown as line 363*d*). During this time, $I_{drive}$ (shown as dashed line 383*b*) is decreasing in relation to the change in drive load 232, and the load presented by amplifier loop circuit 366 is changing to negate the change in drive load 232. Said another way, $I_{switch}$ (shown as line 393*d*) is increasing at a rate complementary to the decrease in $I_{drive}$ (shown as dashed line 383*b*). At time $T_5$, drive load 232 is disconnected from node 230 and $I_{drive}$ equals zero. At this time, $I_{load}$ (shown as line 363*d*) equals $I_{switch}$ (shown as line 393*e*).

Figure 3C:
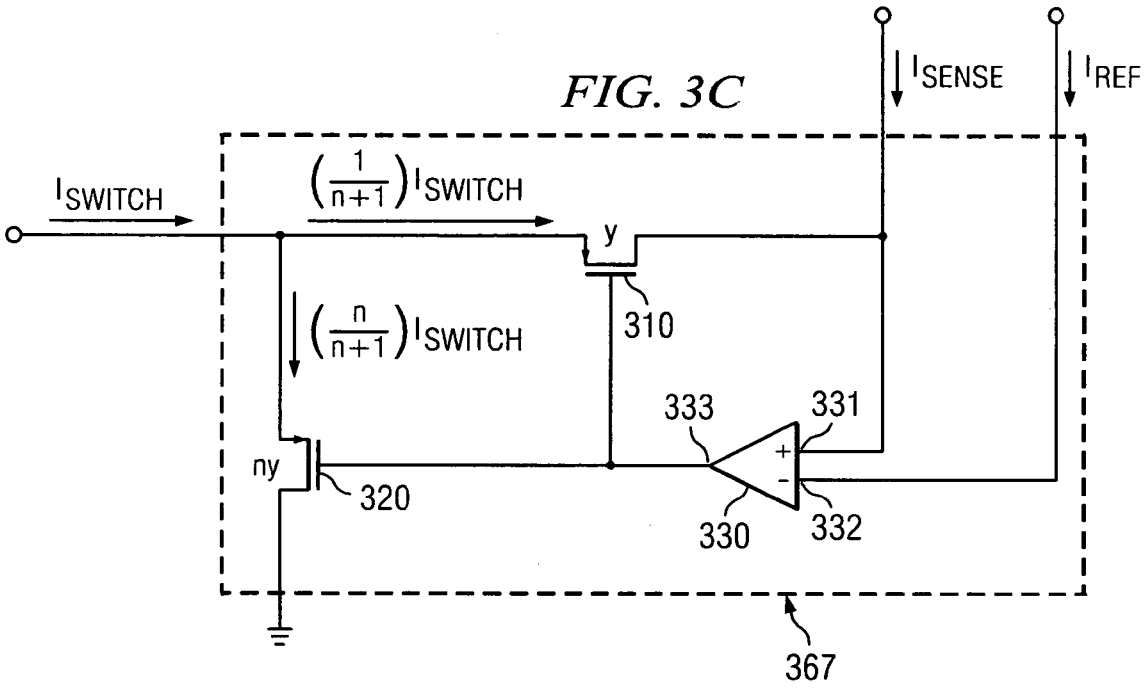
FIG. 3C shows an exemplary amplifier loop circuit that may be used in relation to the system depicted in FIG. 3A.

Turning to FIG. 3C, an exemplary circuit 367 is illustrated. Exemplary circuit 367 may be used to perform the functions of amplifier loop control 366 of switched load system 300 depicted in FIG. 3A. Circuit 367 includes a current input operational amplifier 330 receiving $I_{sense}$ at a positive input 331, and $I_{ref}$ at a negative input 332. An output 333 of current input operational amplifier 330 is electrically coupled to the gate of a FET 310, and to the gate of a FET 320. The source of FET 310 and the source of FET 320 are electrically coupled to $I_{switch}$. The drain of FET 320 is electrically coupled to ground, and the drain of FET 310 is electrically coupled to $I_{sense}$. As shown, the size of FET 320 (nY) is "n" times larger than the size of FET 310 (Y). Based on the disclosure provided herein, one of ordinary skill in the art will appreciate other circuits that may be utilized to perform the functions of amplifier loop control 366.

Operation of circuit 367 is described in relation to switched load system 300 where circuit 367 takes place of amplifier loop control 366. In operation, circuit 367 forces $I_{drive}+I_{switch}$ to be greater than or equal to $nI_{ref}$. To do this, FET 310 and FET 320 are switched based on the current differential across the inputs 331, 332 of current input operational amplifier 330. Where $I_{sense}$ is not substantially less than $I_{ref}$, FETs 310, 320 are not switched and $I_{switch}$ is approximately equal to zero. In this situation, $I_{load}$ is approximately equal to $I_{drive}$ where the current through resistor 218 and the feedback loop to operational amplifier 212 is insignificant relative to $I_{drive}$. This operation is depicted as line 363*b* and line 363*c* of graph 351.

In contrast, where $I_{sense}$ becomes substantially lower than $I_{ref}$ as would occur where drive load 232 is removed, a voltage sufficient to swith FET 310 and FET 320 will exist at output 333 of current input operational amplifier 330. In this condition, the following equations approximately describe the various currents in switched load system 300 where FET 214 is "n" times larger than FET 262, and FET 320 is "n" times larger than FET 310:

$$I_{load}=nI_{sense};\text{ and}$$

$$I_{ref}=I_{sense}+(1/n+1)I_{switch}$$

From these two equations, the current supplied ($I_{load}$) when drive load 232 is either disconnected or becomes very large can be derived by solving for $I_{load}$ as follows: Solving the preceding equations for $I_{load}$ yields:

$$I_{load}=nI_{ref}-(n/n+1)I_{switch}$$

This current is depicted as line 363*a* and line 363*d* of graph 351. Where n is large, the following equation provides a reasonable approximation for $I_{load}$:

$$I_{load}=nI_{ref}$$

This establishes an approximate minimum current supplied by switched load system 300 when drive load 232 is removed. As previously stated, one of ordinary skill in the art will appreciate other circuits that may be used to perform the functionality of amplifier loop control 366. Such alternative circuits may provide different minimum load currents and/or characteristics from those described above and shown in relation to graph 351.

The invention has now been described in detail for purposes of clarity and understanding. However, it will be appreciated that certain changes and modifications may be practiced within the scope of the appended claims. Thus, although the invention is described with reference to specific embodiments and figures thereof, the embodiments and figures are merely illustrative, and not limiting of the invention. Rather, the scope of the invention is to be determined solely by the appended claims.

What is claimed is:

1. A circuit for regulator load control for maintaining at least a minimum load current, the circuit comprising:

a load control circuit, wherein the load control circuit includes:

a reference current;

a sense current representative of a load current;

an amplifier loop control circuit which generates a control signal in response to a comparison between the reference current and the sense current; and a switched load, wherein the switched load is electrically coupled to a regulator output and to the control signal, and wherein the switched load is operable to proportionately increase or decrease in loading factor in response to the control signal to maintain at least a minimum load current for regulator stability without overvoltage measurement.

2. The circuit of claim 1, wherein the circuit further comprises:

a voltage regulator circuit, wherein the voltage regulator circuit provides the load current and the regulator output.

3. The circuit of claim 2, wherein a drive load is electrically coupled to the regulator output, and wherein the load current includes both current provided to the drive load and current provided to the switched load.

4. A method for controlling voltage regulator loading, the method comprising:

providing a voltage regulator circuit, wherein the voltage regulator circuit provides a load current at a regulated voltage;

providing a reference current;

providing a switched load, wherein the switched load is electrically coupled to the load voltage signal;

comparing a representation of the load current with the reference current; and based only on comparing the representation of the load current with the reference current, activating a load control signal; wherein the switched load is proportionally increased or decreased in loading factor wherein a minimum load value is selected such that the voltage regulator circuit is maintained in an operationally stable state.

5. The method of claim 4, wherein the load control signal is a substantially smooth signal transitioning between three or more levels, wherein a first of the three or more levels corresponds to the first loading factor, and wherein a second of the three or more levels corresponds to a second loading factor.

6. A system for providing regulator load control for maintaining at least a minimum load current, the system comprising:

a voltage regulator circuit, wherein the voltage regulator circuit drives a load voltage signal, and provides a load current;

a load control circuit, wherein the load control circuit is operable to sense the load current; and a switched load, wherein the switched load is electrically coupled to the load voltage signal; and wherein, based only on the sensed load current, the load control circuit is operable to modify the switched load;

wherein the switched load is a proportionally switched load, and wherein activating the switched load includes switching the load to one of a plurality of load factors.

7. The system of claim 6, wherein the load control circuit generates a load control signal.

8. The system of claim 7, wherein the load control signal is a substantially smooth signal transitioning between three or more levels.

* * * * *